US005865042A

United States Patent [19]

Cerqua

[11] Patent Number: 5,865,042

[45] Date of Patent: Feb. 2, 1999

[54] SEGMENTED TRANSFORMABLE JEWELRY ARTICLE HAVING VARIABLE STRUCTURAL DIMENSIONS

[76] Inventor: Claudio Christian Cerqua, Largo Veratti, 29-Rome, Italy, 00146

[21] Appl. No.: 809,814

[22] PCT Filed: Jul. 29, 1996

[86] PCT No.: PCT/IT96/00154

§ 371 Date: Mar. 31, 1997

§ 102(e) Date: Mar. 31, 1997

[87] PCT Pub. No.: WO97/04680

PCT Pub. Date: Feb. 13, 1997

[30] Foreign Application Priority Data

Jul. 31, 1995 [IT] Italy ..... RM95A0533

[51] Int. Cl.[6] ..... A44C 13/00

[52] U.S. Cl. ..... 63/1.11; 63/12; 63/15.1; 63/40

[58] Field of Search ..... 63/1.11, 15, 15.1, 63/12, 13, 40, 20

[56] References Cited

U.S. PATENT DOCUMENTS

| | | |
|---|---|---|
| 404,956 | 6/1889 | Burdon . |
| 1,224,193 | 5/1917 | Milhening . |
| 1,327,606 | 1/1920 | Bacharach . |
| 2,128,644 | 8/1938 | Gittler . |
| 4,114,398 | 9/1978 | Orlandini . |
| 4,226,094 | 10/1980 | Wolpoff . |

FOREIGN PATENT DOCUMENTS

| | | |
|---|---|---|
| 208179 | 3/1957 | Australia . |
| 0529168 | 3/1993 | European Pat. Off. . |
| 2693880 | 7/1992 | France . |
| 9016842 | 4/1992 | Germany . |
| 2210249 | 6/1989 | United Kingdom . |
| 9422341 | 10/1994 | WIPO . |

*Primary Examiner*—Kien T. Nguyen
*Attorney, Agent, or Firm*—Browdy and Neimark

[57] ABSTRACT

A system for the realization of gold-work and/or jewelry articles, out of precious metals designed in intermediate and end sections each provided with corresponding coupling means of different kinds, that permit engagement in sequence of said sections to produce different products, that may be varied according to demand.

10 Claims, 5 Drawing Sheets

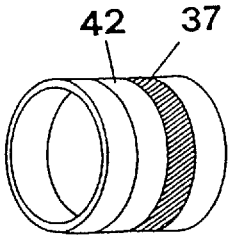
FIG.24
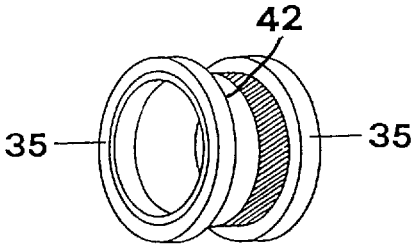
FIG.25
FIG.26
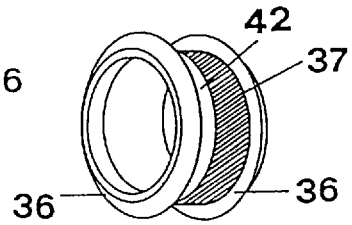
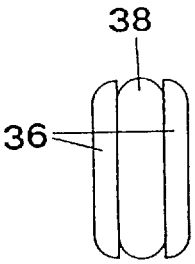
FIG.27
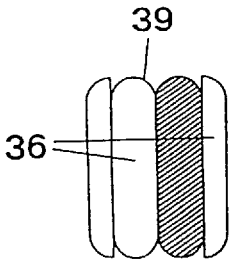
FIG.28
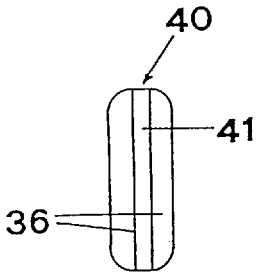
FIG.29
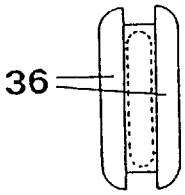
FIG.30
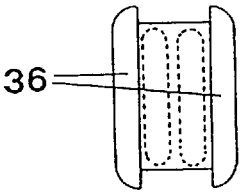
FIG.31

SEGMENTED TRANSFORMABLE JEWELRY ARTICLE HAVING VARIABLE STRUCTURAL DIMENSIONS

BACKGROUND OF THE INVENTION

Technical Field

The present invention concerns a system for the realization of gold-work and/or jewellery articles, out of precious metals and not, comprising a plurality of modules, designed as intermediate and end annular elements, all provided with coupling means, of the male-female alternate kind, so as to obtain, by the connection in sequence of said elements, compact but different products, that may be varied in time according to the demands.

OBJECT OF THE INVENTION

The advantages deriving from the present invention are many and considerable as suggested below.

A considerable reduction of the production costs, due to the nearly complete elimination of the weldings;

the multi-functionality, following to the realization of articles consistent one with the other, that may be transformed and that even transform themselves, that are able to change—completely or only partially—their use, e.g. from rings into ear-rings making use of means for coupling intermediate annular and end annular elements together so as to create a system of articles consistent with each other;

the possibility of realizing catalogues of modules and components, in which the user may choose and compose articles that may be assembled according to his own taste, or may extend his purchase in time;

the possibility of completing a jewel, like a ring or similar, so as to transform it and to adapt it to the changed life and sentimental demands during the whole life of the user, as already claimed by the same applicant in patent applications no. RM 93A000772, RM 93A000223, RM 93A000690 and RM 94A000501;

the possibility of adapting already realized jewels, by means of sections and hooking additions, so as to be inserted in the multifunctional system.

A remarkable feature of the present invention consists of the modification and/or arrangement, during the realization, of the measure of the internal diameter or a ring and/or the wedding ring in particular, so as to allow its adaptation to possible anatomic changes of the user in his lifetime or to change its application, e.g., for wearing it at one finger instead of another one, or from one person to another one.

All said sectors or portions of sectors of the whole structures of the jewels may be arranged for being personalized with the addition of interchangeable modules.

By making of the means for coupling, according to the present invention the connection of intermediate and end annular elements is possible, for realizing modular and transformable jewels, e.g., from rings into different rings and/or into ear-rings and/or bracelets or other. Thus, portions of a jewel may be replaced by other portions of other articles, different or already arranged, for varying the aesthetic aspect, as for example when changing the stone of a ring with the one of a bracelet.

BRIEF DESCRIPTION OF THE DRAWINGS

The present invention will be described more in detail hereinbelow relating to the enclosed drawings, in which some embodiments are shown:

FIGS. 24, 25, 26, show "rings for the life" similar to those shown in FIGS. 21, 22, 23, with the central part divided into two sectors, respectively out of white gold and platinum;

FIG. 27, shows a "ring for the life" consisting of an intermediate wedding ring of white gold/platinum, and half, end wedding rings of gold;

FIG. 28, shows a "ring for the life" consisting of an intermediate part shaped in two double wedding rings out of a platinum/white gold and half, end wedding rings out of gold;

FIG. 29, shows an independent ring consisting of two half, end wedding rings united by a small connection ring;

FIGS. 30, 31, show "rings for the life" that may receive, inside themselves, one or more wedding rings out of white gold/platinum, in silver or golden weddings.

DETAILED DESCRIPTION OF THE PREFERRED EMBODIMENT(S) OF THE INVENTION

Figure 1:
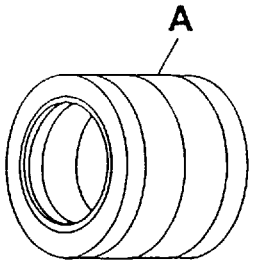
FIG. 1, shows a multi-functional ring consisting of four modular elements.
Figure 2:
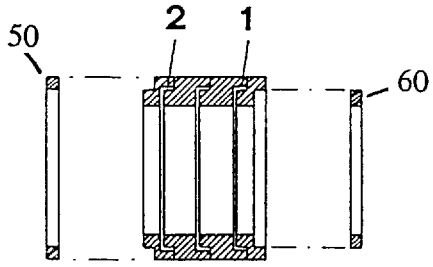
FIG. 2, shows a section of a multifunctional ring of FIG. 1 and the detail of the ends for covering the coupling means.
Figure 3:
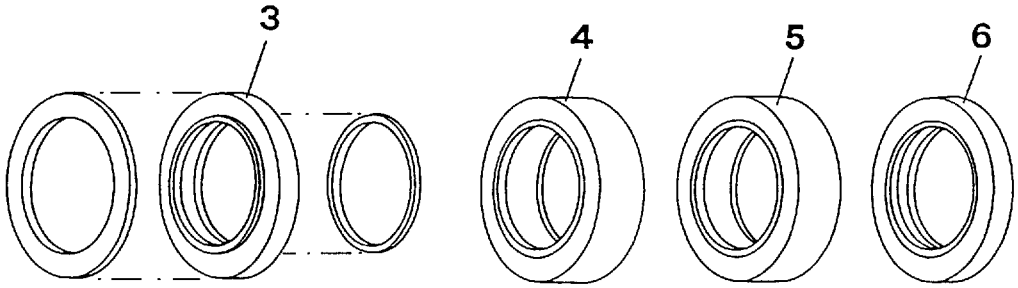
FIG. 3, shows the multi-functional ring of FIG. 1 opened into four independent rings.
Figure 4:
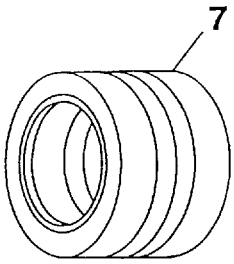
FIG. 4, shows the multi-functional ring of FIG. 1 in an assembling variant.
Figure 5:
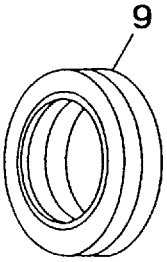
FIG. 5, shows an independent ring formed by two smaller elements of FIG. 1.
Figure 6:
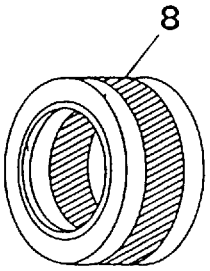
FIG. 6, shows a ring formed by two end elements and one intermediate element provided by another multi-functional ring.
Figure 7:
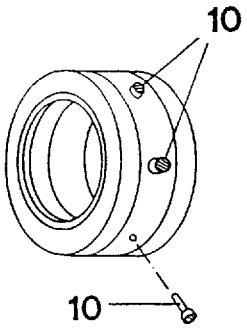
FIG. 7, shows a multi-functional ring with decorations that may be replaced.
Figure 8:
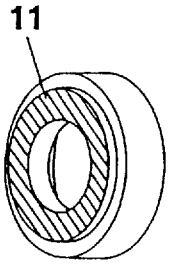
FIGS. 8, 9, 10, show multi-functional rings with different internal diameters.
Figure 9:
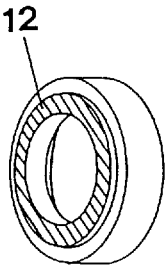
Figure 10:
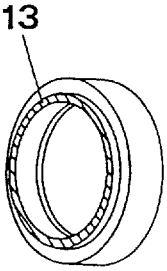
Figure 11:
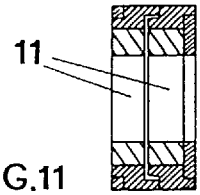
FIGS. 11, 12, 13, show assemblying variants of the rings of FIGS. 8, 9, and 10 with diversified diameters.
Figure 12:
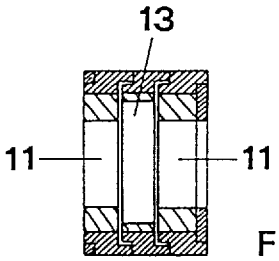
Figure 13:
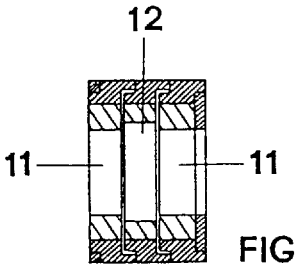

The enclosed figures show a system for the realization of gold-work and/or jewellery articles, in intermediate and end modules, that may be variedly assembled in sequence, comprising:

corresponding coupling means provided at the sides of the modules, in male 1-female 2 sequence, in such a way as to form rings A or independent, disassembled rings 3, 4, 5, 6, or compound rings 7, with different sequences with end annular elements being provided in the shape of rings 50 and 60;

differentiated sectors 8, received in different rings for forming rings 9, while a ring from which a sector has been removed, may be closed again independently or used for the assembling of other jewels;

replaceable decorations 10, consisting of portions of other articles;

differentiated internal diameters 11, 12, 13, that may be assembled variedly, for modifying the internal dimensions and/or the fingers.

Figure 15:
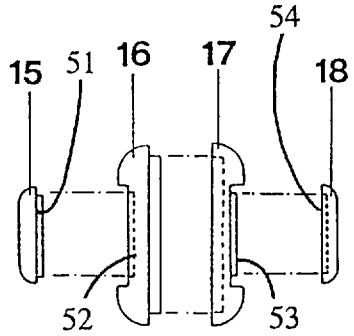
FIG. 15, shows an exploded view of the wedding ring of FIG. 14 with four elements.
Figure 16:
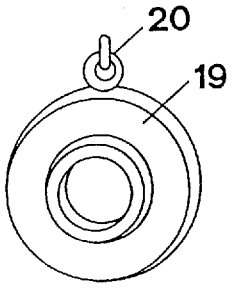
FIG. 16, shows a wedding ring transformed into a pendant.
Figure 17:
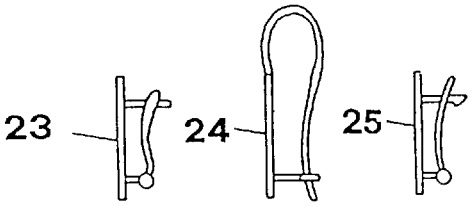
FIG. 17, shows variants of fasteners that may be used for the ear-ring of FIG. 18.
Figure 18:
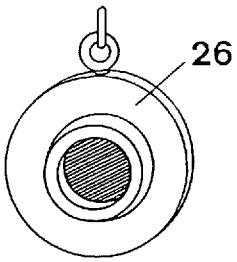
FIG. 18, shows a wedding ring transformed into a picture-frame.
Figure 19:
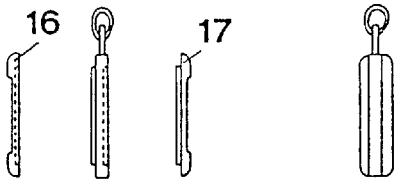
FIG. 19, shows an exploded and lateral view of the picture-frame of FIG. 18.
Figure 20:
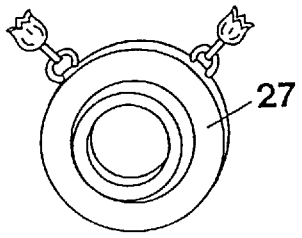
FIG. 20, shows central stones with the application of a wedding ring.

In FIG. 15, a wedding ring 14 is shown composed of four annular elements (14, 15, 17, 18) coaxially connected in succession by means of male coupling 51, a female coupling 52, a male coupling 53 and a female coupling 54.

Figure 14:
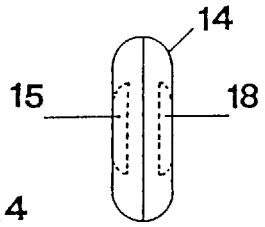
FIG. 14, shows a wedding ring with four elements.

By applying above mentioned coupling means, the wedding ring 14 with four elements 15, 16, 17, 18 (shown in FIGS. 14, 15), may be transformed into a pendant 19, with the addition of the suspension ring 20, or into an ear-ring 21 with the fasteners 22, 23, 24, 25 for application to the lobes of the ears, or into picture-frames 26 or central stones 27, 28.

Figure 21:
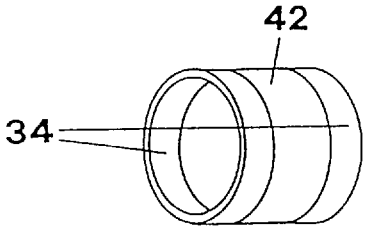
FIG. 21, shows a "ring for the life" in a version of a single ring, with the intermediate part being white gold and the end parts being gold.
Figure 22:
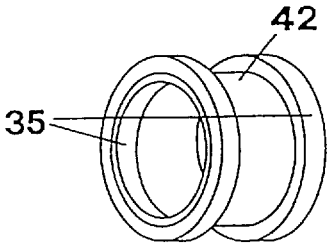
FIG. 22, shows a "ring for the life" in a version for engagement, with the intermediate part being white gold and the extroverted ends of gold.
Figure 23:
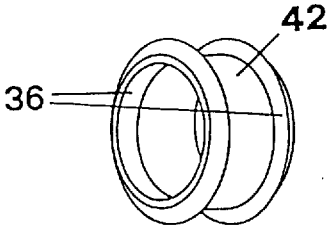
FIG. 23, shows a "ring for the life" in a version for marriage, with the intermediate part being white gold and half, end wedding rings of gold.

As shown in FIG. 21, following the above described application, the ring that follows the user his whole life long will be transformed—starting from an intermediate white gold sector 42 and from two lateral golden end parts 34, having the same outer diameter—on occasion of an engagement, by replacing two extroverted end parts 35 so as to form a central groove (see FIG. 22), and on occasion of a wedding, by replacing two golden half-wedding rings 36 (see FIG. 23).

In a variant, the intermediate part may be divided into two sectors, as shown in FIGS. 24, 25, 26, out of white gold 42 and platinum 37, in a plain version as well as with extroverted ends 35 and with lateral half-wedding rings 36 (see FIGS. 25 and 26).

Relating to FIG. 27, the "ring for the life" may be formed with a central white gold or platinum wedding ring 38, and with two external golden half-wedding rings 36.

FIG. 28 shows a variant of the system according to the present invention, consisting of an intermediate wedding ring 39, formed with two elements, out of platinum and/or white gold, that allows the realization of an independent ring 40 as shown in FIG. 29, consisting of two half-wedding rings 36 linked by a small intermediate connection ring 41 or by a plurality of small rings at different levels.

On occasion of silver or golden weddings, the "ring for the life" provides the presence, inside the same, of respectively one or two white gold or platinum wedding rings, as shown in FIGS. 30, 31.

In a possible variant of the system according to the present invention, the ring provides—for using and developing the same ring from engagement to marriage and to silver wedding—the presence, since the beginning, of a greater intermediate sector, having such dimensions as to contain inside a wedding ring, with lateral end parts, also like half-wedding rings, shaped and dimensioned in such a way as to transform said intermediate sector into a shell.

If, on the other hand, a platinum wedding ring is desired, said central sector will be realized with larger dimensions, or a further sector will be added. If, on the other hand, the central, shell-shaped part of the "ring for the life" is not to be used, said central part may be realized with two flat sectors having the shape of a wedding ring, one out of white gold and one out of platinum, placing at the sides thereof the two golden ends.

In a further variant that may be applied also to finished rings, the internal diameter may be varied by replacing end parts of different measures.

Furthermore, it will be possible to assemble one or more small rings at different levels for realizing a groove, and to transform said wedding ring into a shell for receiving inside one or more rings, realizing a wedding ring into two sections and/or cutting an already existing wedding ring and providing it with one or more internal hookings at different levels.

The possibility of obtaining a plurality of functions, due to the system according to the present invention, allows a ring to interact with a plurality of rings having the same internal diameter, but also allows the same ring to get assembled and disassembled with rings having different internal diameters and to make use of arranged sectors.

The sequency of the male-female coupling means allows to insert a sector into an article performing a plurality of functions, or to cut it, still maintaining the capacity of getting composed again.

One single ring may be undone into a plurality of independent rings with different internal diameters, making use of sectors, end parts, internal rings and shells of different thickness.

Said sectors may be realized in all dimensions, according to their functions, and all replaceable between themselves with arranged, compatible coupling means, and at different levels one to the other inside one and the same article, as well as being disposed one below the other or parallel to each other and/or transversal oblique.

For what concerns the coupling of the intermediate and end elements, they may be all known kinds; furthermore, the elements may provide the use of accessories of different kind, like reducers or enlargers, structures or modules arranged and provided with unified hookings for obtaining transformations from an object to another one. Two or more of said elements may form a shell or have a different internal diameter or be shaped differently, having furthermore couplings of the same kind, at the same level and of the same dimensions and shapes, so as to realize a unified system in which all said elements or rings having the same internal finger diameter, or planned measure groups, are compatible with each other so as to be undone and/or composed in all possible manners.

As a consequence, also the already existing rings—besides those realized with the realization system and relative process according to the present invention—may all be transformed and/or sectioned and/or provided with dimensioned and corresponding coupling means, so as to make them compatible with other multifunctional articles, and applying to them also lateral end parts which allow the modification of their internal diameter, according to the purpose of the present invention.

In that way, the articles and/or the multifunctional rings, obtained with the realization process according to the present invention, may be formed by a whole of rings and/or shells of any shape, variedly assembled into a compound that follows the most important moments in the life of a person.

The realization process according to the present invention also allows to tighten and to widen any kind of ring, as already described. Furthermore, in a variant, in the case of a shell-shaped wedding-ring, containing a second wedding-ring, it may be arranged to leave between the two a hollow space so that, if the end parts will be replaced with new ones having a wider inner diameter, and widening with a conventional system said inner wedding-ring, the latter will occupy said hollow space, varying the inner diameter.

In a further variant the inner wedding-ring, of the greater thickness, may be widened by turning.

Also one single sector may form, according to the present invention, an independent ring, as it is provided with at least two hookings on each side, to which two lateral end parts may be applied for determining the inner diameter, according to the needs.

If above described widening and tightening processes can not be applied, the system according to the present invention provides the arrangement of a ring in three sectors—a central and two end sectors—wherein the central one is overdimensioned so as to be carried on a larger finger, and the end sectors are realized with different inner diameters for being carried on different fingers or by different persons, so as to reduce the need of the large choice for the dealers, in detail for special rings like those with a diamond pave or those out of platinum with white gold surfacing and stones or enamels. In such a case, each of said end parts has small rings incorporated, for entering completely or partially inside the sector.

In a variant, an intermediate ring may be enlarged between two circular sectors—a female one, provided with a threaded metal ring in its internal diameter, and a male one with a corresponding threading on its external diameter—so that the latter may get inserted and screwed, inside said ring, to said first sector. The male as well as the female sectors have, in their end part, circumferential projections that may be housed in corresponding grooves obtained on the edge of the ring, which they modify.

After a light turning in the inner wall of the ring, a small ring may be inserted under pressure and, if necessary, it may be replaced with a plurality of small rings of different thickness.

I claim:

1. A transformable jewelry article comprising a plurality of intermediate annular elements (3, 4, 5, 6; 8; 11, 12, 13, 16, 17, 37, 38, 39, 42), each having said first means for coupling, and further comprising two end annular elements (50, 60; 15, 18; 34, 35, 36) provided with second means for coupling, of a male-female type, respectively corresponding to as said first means for coupling;

an internal diameter of said end annular elements being no greater than a minimum internal diameter of said intermediate annular elements;

said intermediate annular elements and said end annular elements being engaged in a removable coaxial coupling action.

2. The transformable jewelry article of claim 1, wherein said first coupling means is constituted by: a male coupling, constituted by a circumferential protuberance (1) on a face of an intermediate element of said intermediate elements and a female coupling, constituted by a circumferentially-disposed channel (2); said protuberance (1) projecting from said face of said intermediate element and having an internal diameter which is slightly greater than an external diameter of said channel (2) afforded in an opposite face of said intermediate element.

3. The transformable jewelry article of claim 2, wherein said second means for coupling of said end annular elements (50, 60) are rings which insert externally to said protuberance (1) and internally of said channel (2).

4. The transformable jewelry article of claim 1, wherein said second means for coupling of said end annular elements (50, 60) are rings which insert externally to said protuberance (1) and internally of said channel (2).

5. The transformable jewelry article of claim 1, comprising two end annular elements (15, 18; 36, 37) provided with said second means for coupling, which means are of a male-female type, a male part of said second means being complementary to a female part of said first means for coupling, afforded on a face of intermediate annular element of said intermediate annular elements, and a female part of said second means being complementary to said male part of said first means for coupling, afforded on a face of said intermediate annular element (16, 17, 38, 39, 40).

6. The transformable jewelry article of claim 1, comprising two end annular elements provided with second means for coupling, of a male-female type and also of a screw-coupling type.

7. The transformable jewelry article of claim 1, wherein at least one of said intermediate annular elements is provided with an eyelet (20) through which a line can be passed to form a pendant-type jewelry article.

8. The transformable jewelry article of claim 1, comprising a fastener (22, 23, 24, 25) of a type for transforming said transformable jewelry article into an earring (21).

9. The transformable jewelry article of claim 1, wherein said annular intermediate elements externally exhibit exchangeable decorations (10).

10. The transformable jewelry article of claim 1, wherein at least one of said intermediate annular elements is conformed so as to receive and internally house at least one further ring having an internal diameter which is not smaller than an internal diameter of said end annular element.

* * * * *